United States Patent [19]

Robertson et al.

[11] 4,034,437

[45] July 12, 1977

[54] PRESSURE-FREE FAIL-SAFE EMERGENCY DOOR CLOSER

[76] Inventors: Lyman H. Robertson, 3099 Peachtree Drive NE., Atlanta, Ga. 30305; John D. White, 2015 Deren Way NE., Atlanta, Ga. 30345

[21] Appl. No.: 614,864

[22] Filed: Sept. 19, 1975

[51] Int. Cl.[2] ..... E05F 15/20

[52] U.S. Cl. ..... 16/48.5; 49/2; 49/31

[58] Field of Search ..... 49/1, 2, 3, 5, 7, 8, 49/31, 29, 30; 16/48.5; 229/144; 200/61.03

[56] References Cited

U.S. PATENT DOCUMENTS

| | | | |
|---|---|---|---|
| 834,681 | 10/1906 | Peters | 49/1 |
| 2,651,074 | 9/1953 | Slopa et al. | 16/80 |
| 3,284,840 | 11/1966 | Ulman | 16/48.5 |
| 3,908,309 | 9/1972 | Coulter et al. | 49/31 |
| 3,915,377 | 10/1975 | Sutton, Jr. | 49/2 X |
| 3,934,306 | 1/1976 | Farris | 16/48.5 |

*Primary Examiner*—Kenneth Downey
*Attorney, Agent, or Firm*—John D. White

[57] ABSTRACT

A normally pressure-free, failsafe, emergency door closer for use in hospitals, nursing homes or other locations where handicapped persons are housed, comprising an actuating mechanism triggered by a sensing device such as a smoke detector, a spring-loaded arm with a bumper on one end to engage the door and the other end of the arm rotatably attached to the wall adjacent to and above the door and free to rotate in a horizontal plane. The spring-loaded arm is retained in an open position by a vertical pin engaging the horizontal closer arm. The pin is mechanically linked to the armature of an electromagnet opposed by a coil spring. On signal from the sensing device the electromagnet releases the armature and the coil spring urges the pin upwards releasing the closer arm, the end of which engages the door and closes it.

3 Claims, 6 Drawing Figures

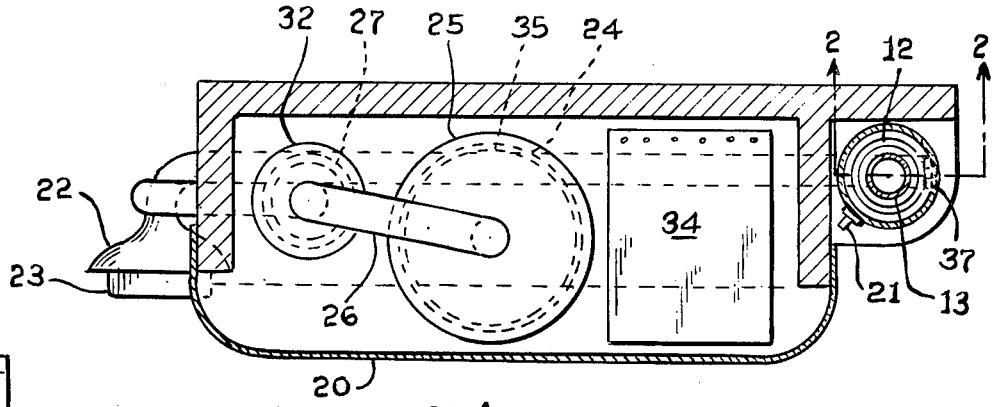
Fig.1
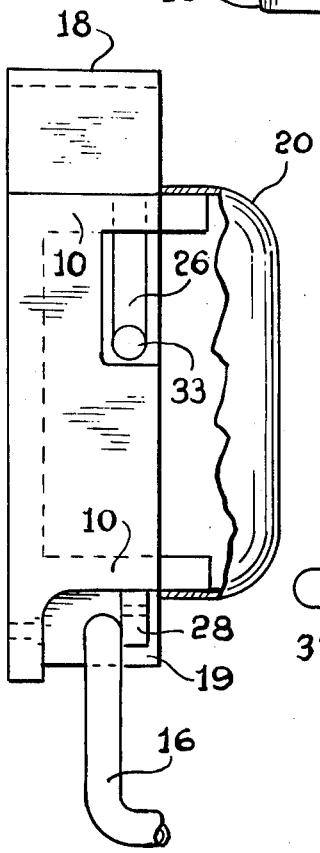
Fig.4
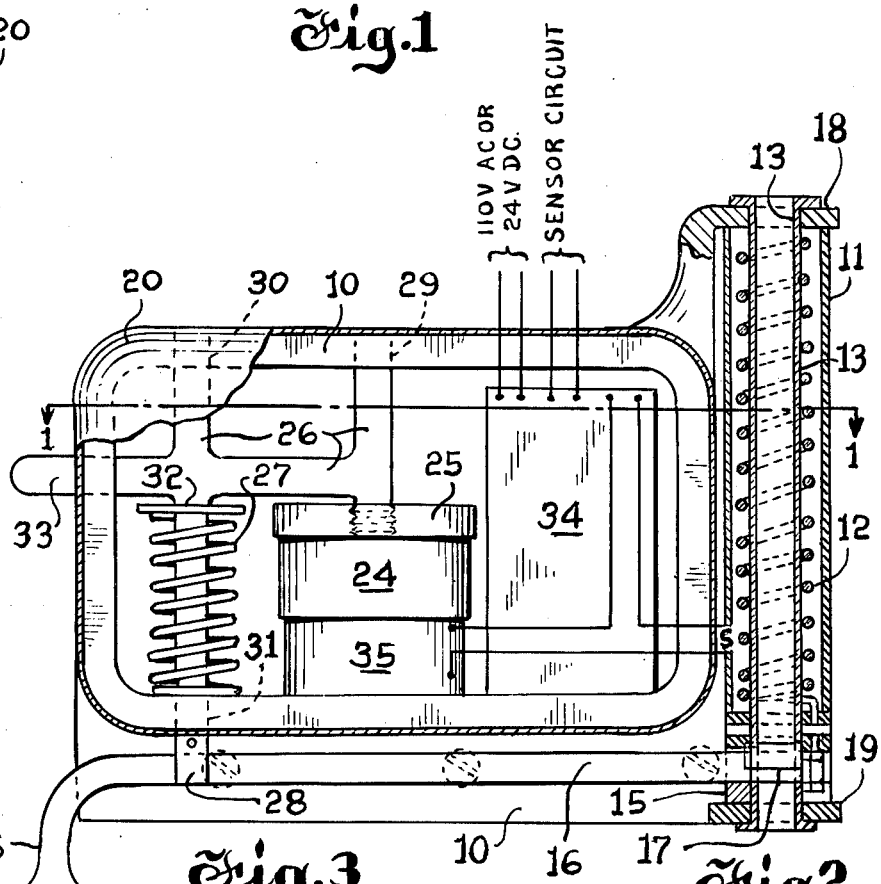
Fig.3
Fig.2
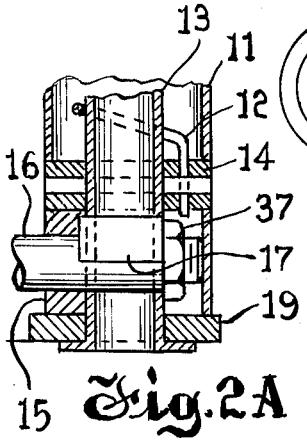
Fig.2A
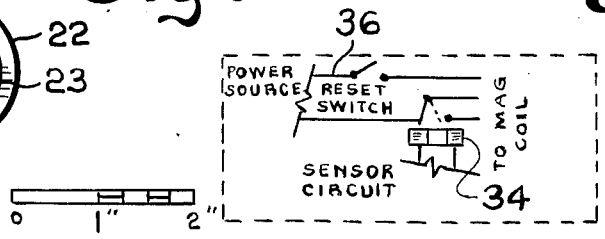
Fig.5

PRESSURE-FREE FAIL-SAFE EMERGENCY DOOR CLOSER

This invention relates, in general, to improved door closers.

In buildings housing elderly and infirm persons, fire safety is of utmost importance. The elderly and infirm generally require the assistance of others in the event of an emergency since they have limited strength and mobility. Additionally their response to emergency situations is slower than is that of normal persons allowing a shorter time period for life saving measures. Accordingly, buildings designed primarily to house the elderly or infirm are required to meet more stringent fire safety requirements than those designed for ordinary use.

One of the fire safety requirements for buildings housing the elderly or infirm is that of automatic or alarm actuated door closers to confine smoke or flame in the event of a fire.

In the normal installation, the door closer is of the automatic type, is mounted on the door and is of either a hydraulic or spring-loaded motive force. Such a closer exerts a pressure on a door at all times when it is opened. Thus, anyone at any time going through a door equipped with such a closer must overcome the pressure of the closer to gain passage through the doorway.

Alarm actuated door closers are also found in the prior art. These door closers are of several types but all contain one undesirable feature. They are attached directly to the door and require the exertion of some small force to open the door to overcome the inertia of the closer under normal or non-emergency conditions.

Pressures on doors of a magnitude of no consequence to normal, healthy persons are formidable obstacles to the elderly or infirm. In many installations housing the elderly or infirm, the day to day inconvenience of pushing against the numerous fire-safety door closers has caused the removal of the door closers in violation of the fire safety codes.

Accordingly, an object of the present invention is to provide improved emergency door closers which are normally pressure free.

Another object of the present invention is to provide an emergency door closer which will operate on signal from a sensing device such as a smoke detector.

Still another object of the present invention is to provide emergency door closers which will fail-safe when power outages occur.

The above objectives are accomplished with a door closer which includes, generally, an actuating mechanism triggered by a sensing device such as a smoke detector, a spring loaded arm with a bumper on one end to engage the door and with the other end of the arm rotatably attached to the wall adjacent to and above the door, said arm being free to rotate in a horizontal plane. The spring loaded arm is retained in an upper position by a vertical pin engaging the horizontal closer arm. The pin is mechanically linked to the armature of an electromagnet opposed by a coil spring; the force exerted by the electromagnet overcoming the force exerted by the coil spring.

The electromagnet is controlled by a relay connected to a sensing device such as a smoke detector which on signal interrupts the current to the electromagnet to release the armature. The coil spring urges the pin in an upward direction thereby releasing the closer arm. The bumper end of the closer arm swings in a horizontal plane until it engages the door and transmits the force of the tensioned helical spring mechanically connected to the closer arm to the door urging the door to a closed position. The door closer transmits no pressure to the door until it is actuated by the sensing device. Upon interruption of power whether through the relay controlled by the sensing device or by emergency power outage, the door closer is actuated; therefore the operation of the closer is fail-safe. A time delay relay is utilized to prevent tripping the door closer by instantaneous power outages.

The invention accordingly comprises an article of manufacture possessing the features, properties, and the relation of elements which will be exemplified in the article hereinafter described and the scope of the invention will be indicated in the claims.

For a fuller understanding of the nature and objects of the invention, reference should be had to the following detailed description taken in connection with the accompanying drawings in which:

FIG. 1 is a plan view of a pressure-free fail-safe emergency door closer exemplary of the present invention;

FIG. 2 is a sectional view taken along lines 2—2 of FIG. 1;

FIG. 2A is an enlarged sectional view of FIG. 2 showing the details of the connection of the closer arm, helical spring and hollow shaft;

FIG. 3 is a front elevation view of the present invention;

FIG. 4 is an end view of the present invention;

FIG. 5 is a schematic diagram of the electrical power and control circuits.

Similar reference characters refer to similar parts throughout the several views of the drawing.

Referring now to the drawing FIGS. 1 through 5, there is shown a structural frame 10 suitable for mounting the various parts of the invention and suitable for mounting the closer on the wall adjacent to and above the door to be closed. The center line of the hollow shaft 13 is normally coincident with the center line of the hinges of the door, although not necessarily so.

Inside a tubular cover 11 is contained a helical spring 12 wound around a hollow shaft 13, and the shaft 13 and top portion of the spring 12 are free to rotate inside the tubular cover 11. The upper end of the spring 12 is firmly attached to the circumference of the shaft 13 by mechanical means. The lower end of the spring 12 is firmly attached by mechanical means to the circumference of a rotatable ring 14 mounted on the hollow shaft 13. Below the rotatable ring is a spacer ring 15 mounted on the shaft 13 immovably attached to the shaft 13 by the closer arm 16 traversing the ring at a right angle to its vertical axis. The closer arm 16 is firmly attached to the shaft 13 by an upset in the closer arm diameter on one side of the shaft 13 and by a nut 37 pulled up snugly against the other side of the shaft 13 on the threaded end of the closer arm 16. Thus the closer arm 16, the spacer ring 15, the shaft 13 and the nut 37 are immovably attached to each other. The closer arm 16 is further prevented from rotation by a key 17 fitted in conforming slots in both the closer arm 16 and the shaft 13.

The hollow shaft 13 is adapted for rotation around a vertical axis by a top bracket 18 containing a sleeve and a bottom bracket 19 containing a sleeve, both brackets being an integral part of the frame 10.

Equally spaced around the circumference of the rotatable ring 14 is a series of holes, perhaps 8 in number and 5/32 inch in diameter. By use of a pick (not shown) inserted in the holes successively in the rotatable ring 14, and holding the spring tension in each instance by resetting the pin 21 manually to increase the effective length of the spring 12, a torque can be maintained on the spring 12 to any degree within reasonable limits to wind the spring 12.

The force necessary to close any particular door must be determined by trial and error as the force required is not only a function of the door size and weight, but of the accuracy with which the door was hung and the condition of the hinges. Generally the range will be from 4 to 25 pounds.

When the spring 12 has been tensioned the estimated necessary amount, the rotatable ring 14 is secured to the frame 10 by the pin 21 thereby transmitting the force of the wound spring 12 to the closer arm 16. The closer arm 16 is adapted to engage the door by the off-set bumper 22 containing an elastic bumper block 23 which meets the door without causing structural damage.

When the vertical axis of the shaft 13 is aligned with the axis of the door hinge, a bumper 22 and bumper block 23 may be used as illustrated in the drawing. If it is more convenient to off-set the vertical axis of the shaft 13 from the axis of the hinge, a roller on a vertical axis or an elastic ball fitted in a frame (not shown) may be substituted for the bumper 22 and bumper block 23 shown in the drawing.

In the normal position, the closer arm 16 is held in the open position, as shown in FIGS. 1 through 4, and the door is free of any closer pressure. Movement of the closer arm 16 is blocked by the "down" position of the pin 28 which is held down by the superior force of the electromagnet 24 acting on the armature 24 which transmits the force through linkage member 26 overcoming the force of the coil spring 27 acting opposed to it.

The linkage member 26 and pin 28 is restrained to vertical movement by sleeves 29, 30 and 31 in the frame 10. The coil spring 27 is compressed between a washer 32 held in place with respect to the linkage member 26 by an upset in diameter of the linkage member 26 engaging the inside circumference of the washer 32, and the frame 10.

Appertenant to the linkage member 26 is the reset handle 33 providing a manual means to reset the closer after it has been actuated.

The pin 28 contains a horizontal hole about ⅛ inch in diameter adapted to accept a cotter pin which will bear against the underside of the frame 10 at the sleeve 31 and prevent operation of the door closer during planned power outages or for other maintenance purposes.

The closer is actuated by an electrical signal from a smoke detector or similar sensor circuit (not shown) received by the normally closed relay 34 which opens the circuit and interrupts the electrical current to the magnet coil 35. The relay 34 contains a time delay on deenergization circuit capable of delaying actuation of from 0.6 to 60 seconds. The purpose of the time delay circuit is to prevent tripping the closer during instantaneous power outages or when switching over from primary to secondary power source.

When the electromagnet 25 is de-energized, the force of the coil spring 27 acting opposed to the electromagnet is sufficient to overcome the force of friction between the closer arm 16 and the pin 28 and the force of the coil spring 27 urges the pin 28 to an "up" position. The closer arm 16 is under tension from the helical spring 12 urging it to rotate in a horizontal plane, and the closer arm 16 swings to engage the door with the bumper block 23 closing the door.

Similarly, a power interruption of longer period than the time delay set in the relay releases the force of the electromagnet 24 on the armature 25 causing the door closer to actuate, failing safe.

The door closer is reset by opening the reset switch 36, raising the pin 28 by the reset handle 33, cocking the closer arm 16, closing the reset switch 36, and lowering the reset handle 33, so that the pin 28 blocks the closer arm 16.

The frame 10 is enclosed by a suitable cover 20.

It will thus be seen that the objects set forth above, among those made apparent from the preceding description, are efficiently attained and, since certain changes may be made in the above article without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention, which as a matter of language, might be said to fall therebetween.

Now that the invention has been described, we claim:

1. A door closer for closing the door on signal from a sensor circuit comprising, in combination: a frame; a shaft rotatably mounted on said frame; a closer arm one end of which is rigidly attached to the end of said shaft, the axes of said shaft and said closer arm being at nominal right angles to one another, and opposite end of which is adapted to engage a door, said closer arm being biased to urge the door closed; a pin adapted to retain or release said closer arm slideably mounted in said frame; an electromagnet whose armature is mechanically linked to said pin and a compressible coil spring mechanically linked to said pin and to said armature and whose force is opposed to the force of said electromagnet whereby the force of the electromagnet is superior and opposed to the force of the coil spring when energized and when de-energized the force of said coil spring is sufficient to cause the pin to move in an upward direction freeing the closer arm; an electrical power source and electrical circuitry connecting the coil of the electromagnet to the electrical power source; switching means within the electrical circuitry to receive a sensor signal and interrupt the electrical current to the coil on signal; and means for resetting said door closer.

2. A door closer for closing a door on signal from a sensor circuit comprising, in combination: a frame; a shaft rotatably mounted on said frame; a closer arm one end of which is rigidly attached to the end of said shaft, the axes of said shaft and said closer arm being at nominal right angles to one another, and the opposite end of which is adapted to engage a door, said closer arm being biased to urge the door closed; a pin adapted to retain or release said closer arm slideably mounted in said frame; an electromagnet whose armature is mechanically linked to said pin; and a compressible coil spring mechanically linked to said pin and to said armature and whose force is opposed to the force of said electromagnet whereby the force of the electromagnet is superior and opposed to the force of the coil spring when energized and when de-energized the force of said coil spring is sufficient to cause the pin to move in an upward direction freeing the closer arm; an electrical power source and electrical circuitry connecting the coil of the electromagnet to the electrical power source; switching means within the electrical circuitry to receive a sensor signal and interrupt the electrical current to the coil on signal; a time delay device incorporated in said electrical circuitry for protection against instantaneous power interruptions; and means for resetting said door closer.

3. A door closer for closing a door on signal from a sensor circuit comprising, in combination: a frame adapted for mounting on a nominally vertical surface and for mounting the various parts of the closer; a shaft rotatably mounted on one end of said frame; a helical spring wound around said shaft, one end of said spring being firmly attached to an end of said shaft and the opposite end of said spring being adapted to maintain a variable torque on said shaft; a closer arm, one end of which is rigidly attached to the end of said shaft, the axes of said shaft and said closer arm being at nominal right angles to one another, and the opposite end of said closer arm being constructed to engage a door and urge it closed; a pin adapted to retain or release said closer arm slideably mounted in said frame; an electromagnet whose armature is mechanically linked to said pin and a compressible coil spring mechanically linked to said pin and to said armature and whose force is opposed to the force of said electromagnet, whereby the force of the electromagnet is superior and opposed to the force of the coil spring when energized and when de-energized the force of said coil spring is sufficient to cause the pin to move in an upward direction freeing the closer arm; a normally closed relay to receive a sensor signal and interrupt the electrical current to the coil of the said electromagnet; and means for resetting said door closer.

* * * * *